US009556534B2

(12) United States Patent
Morimitsu

(10) Patent No.: US 9,556,534 B2
(45) Date of Patent: Jan. 31, 2017

(54) ANODE FOR ELECTROPLATING AND METHOD FOR ELECTROPLATING USING ANODE

(75) Inventor: Masatsugu Morimitsu, Kyotanabe (JP)

(73) Assignee: THE DOSHISHA, Kyoto (JP)

( * ) Notice: Subject to any disclaimer, the term of this patent is extended or adjusted under 35 U.S.C. 154(b) by 0 days.

(21) Appl. No.: 14/344,675

(22) PCT Filed: Aug. 13, 2012

(86) PCT No.: PCT/JP2012/072237

§ 371 (c)(1),
(2), (4) Date: Mar. 13, 2014

(87) PCT Pub. No.: WO2013/038928

PCT Pub. Date: Mar. 21, 2013

(65) Prior Publication Data

US 2015/0027899 A1 Jan. 29, 2015

(30) Foreign Application Priority Data

Sep. 13, 2011 (JP) ..... 2011-199258

(51) Int. Cl.

| | |
|---|---|
| ***C25D 5/00*** | (2006.01) |
| ***C25D 3/56*** | (2006.01) |
| ***C25D 3/12*** | (2006.01) |
| ***C25D 3/04*** | (2006.01) |
| ***C25D 3/38*** | (2006.01) |
| ***C25D 3/34*** | (2006.01) |
| ***C25D 3/30*** | (2006.01) |
| ***C25D 3/22*** | (2006.01) |
| ***C25D 17/10*** | (2006.01) |
| ***C25D 11/02*** | (2006.01) |

(52) U.S. Cl.
CPC ..... *C25D 17/10* (2013.01); *C25D 11/02* (2013.01)

(58) Field of Classification Search
CPC ..... C25D 17/10; C25D 11/02; C25B 11/0478; C25B 11/0484; C25C 1/12; C23C 18/1216; C23C 28/00; C23C 28/046; C23C 3/02; C23C 3/04; C23C 3/12; C23C 3/22; C23C 3/30; C23C 3/38; C23C 3/46; C23C 3/50; C23C 3/54
USPC ..... 205/261, 263, 264, 265, 269, 271, 283,205/291, 299, 300, 305, 80, 238
See application file for complete search history.

(56) References Cited

U.S. PATENT DOCUMENTS

| | | | | |
|---|---|---|---|---|
| 4,005,004 | A | 1/1977 | Seko et al. | |
| 5,982,609 | A | 11/1999 | Evans | |
| 6,210,550 | B1 | 4/2001 | Nidola et al. | |
| 8,679,246 | B2 * | 3/2014 | Jordan et al. | 106/286.4 |
| 2004/0188247 | A1 | 9/2004 | Hardee | |
| 2009/0288856 | A1 * | 11/2009 | Sandoval | C23C 18/1216 174/126.2 |
| 2009/0288958 | A1 * | 11/2009 | Sandoval | C23C 18/1216 205/576 |
| 2011/0079518 | A1 | 4/2011 | Morimitsu | |
| 2012/0247971 | A1 | 10/2012 | Morimitsu | |

FOREIGN PATENT DOCUMENTS

| | | | |
|---|---|---|---|
| EP | 2690200 | A1 | 1/2014 |
| JP | 2000-110000 | A | 4/2000 |
| JP | 3654204 | B2 | 6/2005 |
| JP | 3914162 | B2 | 5/2007 |
| JP | 2007-146215 | A | 6/2007 |
| JP | 2011-017084 | A | 1/2011 |
| JP | 2011-026691 | A | 2/2011 |
| JP | 2011-122183 | A | 6/2011 |
| JP | 4916040 | B1 | 4/2012 |
| WO | 2009/151044 | A1 | 12/2009 |

OTHER PUBLICATIONS

Gorodetskii et al. "Tantalum Oxide Effect on the Surface Structure and Morphology of the IrO2 and IrO2 + RuO¬2 + TiO2 Coatings and on the Corrosion and Electrochemical Properties of Anodes Prepared from These" Elektrokhimiya, 2007, vol. 43, No. 2, pp. 234-240.*

Riberio et al. "Characterization of RuO2—Ta2O5 Coated Titanium Electrode Microstructure, Morphology, and Electrochemical Investigation" Journal of The Electrochemical Society, 151 (10) D106-D112 (2004).*

Ribeiro et al., "Characterization of $RuO_2$—$Ta_2O_5$ Coated Titanium Electrode", Journal of The Electrochemical Society, 2004, pp. D106-D112.

Communication dated May 20, 2015 from the European Patent Office issued in corresponding European application No. 12831342.6.

Yong-Yi Chen et al., "Phase Structure and Microstructure of a Nanoscale TiO2—RuO2—IrO2—Ta2O5 Anode Coating on Titanium", Journal of the American Ceramic Society, 2008, pp. 4154-4157, vol. 91, No. 12.

International Search Report for PCT/JP2012/072237 dated Dec. 4, 2012.

* cited by examiner

*Primary Examiner* — Edna Wong
(74) *Attorney, Agent, or Firm* — Sughrue Mion, PLLC

(57) ABSTRACT

Provided is an anode for electroplating which uses an aqueous solution as an electrolytic solution, and the anode which is low in potential when compared with a conventional anode, able to decrease an electrolytic voltage and an electric energy consumption rate and may also be used as an anode for electroplating various types of metals, and which is low in cost. Also provided is a method for electroplating which uses an aqueous solution as an electrolytic solution, in which the anode is low in potential and electrolytic voltage, thereby making it possible to decrease the electric energy consumption rate. The anode for electroplating of the present invention is an anode for electroplating which uses an aqueous solution as an electrolytic solution, in which a catalytic layer containing amorphous ruthenium oxide and amorphous tantalum oxide is formed on a conductive substrate.

9 Claims, No Drawings

ANODE FOR ELECTROPLATING AND METHOD FOR ELECTROPLATING USING ANODE

CROSS REFERENCE TO RELATED APPLICATIONS

This application is a National Stage of International Application No. PCT/JP2012/072237 filed Aug. 13, 2012, claiming priority based on Japanese Patent Application No. 2011-199258 filed Sep. 13, 2011, the contents of all of which are incorporated herein by reference in their entirety.

TECHNICAL FIELD

The present invention relates to an anode for electroplating used in electroplating which reduces metal ions in an aqueous solution on a cathode, thereby producing a desired metal film or metal foil and also to a method for electroplating which reduces metal ions in an aqueous solution on a cathode, thereby producing a desired metal film or metal foil.

BACKGROUND ART

Electroplating is a method to produce a metal film or metal foil by electrolyzing a solution which contains metal ions (hereinafter referred to as an electrolytic solution). For example, an electrolytic zinc-coated steel plate used for a vehicle body is such that a steel plate is immersed in an aqueous solution in which zinc ions are dissolved and the zinc ions are reduced by using the steel plate as a cathode to form a zinc film on the steel plate. Further, electroplating includes not only a process in which a metal film is formed on a conductive substrate such as a steel plate but also a process in which, for example, as found in production of electrolytic copper foil, a cylindrical and rotatable cathode is partially immersed in an aqueous solution containing copper ions, a copper thin film is continuously deposited on the surface of the cathode, with the cathode being rotated, and at the same time, the thin film is peeled from one end of the cathode to produce copper foil. As described above, metals to be electroplated include such metals as copper, zinc, tin, nickel, cobalt, lead, chromium, indium, platinum group metals (platinum, iridium, ruthenium, palladium, etc.), precious metals (silver or gold), other transition metal elements, metals collectively called rare metal or critical metal, or their alloys. The above-described anode for electroplating is available in various shapes depending on a metal film and metal foil to be produced, however, in terms of materials thereof, the anode includes a carbon electrode made of graphite or glassy carbon, etc., a lead alloy electrode, a platinum-coated titanium electrode and an oxide-coated titanium electrode. In particular, in electrogalvanizing and production of electrolytic copper foil which use a sulfuric acid based acidic aqueous solution containing metal ions, used is an oxide-coated titanium electrode in which a titanium substrate is coated with a catalytic layer that contains iridium oxide. Further, in electroplating which uses a chloride based aqueous solution that contains metal ions, used is an oxide-coated titanium electrode in which a titanium substrate is coated with a catalytic layer that contains ruthenium oxide. The inventor of the present application has disclosed in Patent Literature 1 and Patent Literature 2 an electrode which has a catalytic layer containing crystalline or amorphous iridium oxide formed on a conductive substrate, as an oxide-coated titanium electrode which is used for the above-described anode for electroplating. In addition, an oxide-coated titanium electrode used in electroplating is disclosed, for example, in Patent Literature 3 and Patent Literature 4. In the Patent Literatures described above, examples of electroplating which mainly uses an acidic aqueous solution such as a sulfuric acid based acidic aqueous solution are described. However, electroplating may be performed by using a substantially neutral aqueous solution or an alkaline aqueous solution. The electroplating which has been described in the present invention covers such electroplating that uses an aqueous solution of a wide range of pH, from acidic to alkaline, and such electroplating that uses a chloride based aqueous solution.

Energy consumed in electroplating is the product of electrolytic voltage and amount of electricity used for electrolysis, and an amount of metal deposited on a cathode is proportional to the amount of electricity. Therefore, electric energy per unit weight necessary for a metal to be electroplated (hereinafter, referred to as electric energy consumption rate) is decreased in accordance with a decrease in electrolytic voltage. The electrolytic voltage is a difference in potential between an anode and a cathode, and a reaction of the cathode is different depending on a metal to be electroplated at the cathode and a potential of the cathode is also different depending on a type of the reaction. On the other hand, a main reaction of the anode is production of chlorine where an aqueous solution containing chloride ions at high concentrations is used as an electrolytic solution. Excluding the above case, a main reaction is oxygen evolution when used in an aqueous solution of a wide range of pH. For example, in production of electrolytic copper foil by electroplating, a sulfuric acid based acidic aqueous solution is used, and in gold electroplating, an alkaline aqueous solution is used. In these electrolytic solutions, a reaction of the anode is oxygen evolution; alternatively, a main reaction of the anode is at least oxygen evolution. A potential of the anode when performing electroplating will vary depending on a material used in the anode. For example, when a material having a low catalytic activity for oxygen evolution and/or chlorine evolution which is a reaction of the anode is compared with a material having a high catalytic activity, the higher the catalytic activity, the lower the potential of the anode. Therefore, where electroplating is performed by using the same type of an electrolytic solution, in order to decrease an electric energy consumption rate, it is critical and necessary to use a material high in catalytic activity for the anode so as to decrease a potential of the anode.

Further, an anode used for electroplating is required not only to have a high catalytic activity for oxygen evolution and/or chlorine evolution but also to have a low catalytic activity for a reaction which may take place on an anode other than these main reactions (hereinafter, referred to as a side reaction), contrary to the case of the main reactions. The previously described sulfuric acid based acidic aqueous solution used, for example, in production of electrolytic copper foil contains lead ions as an impurity in addition to copper ions which are an essential component of the electrolytic solution. There is a case that the lead ions may be oxidized on the anode and deposited on the anode as lead dioxide. The above-described deposition of lead dioxide on the anode will take place at the same time with oxygen evolution which is a main reaction of the anode. Lead dioxide has a low catalytic activity for oxygen evolution and, therefore, inhibits oxygen evolution on the anode and raises a potential of the anode, thereby resulting in an increase in electrolytic voltage. The above-described deposition and accumulation of a metal oxide on the anode by a side reaction increase an electrolytic voltage and also cause decreasing the service life and durability of the anode.

Due to the above-described reasons, the anode for electroplating which uses an aqueous solution as an electrolytic solution is required to have the following features: 1) a high catalytic activity for oxygen evolution and/or chlorine evolution; 2) a low catalytic activity for a side reaction which makes deposition of a metal oxide on the anode and also a side reaction which allows the deposits to adhere and accumulate on the anode even when no metal component is contained; 3) therefore, there is a high selectivity for a main reaction; 4) as a result, the anode is low in potential, in other words, overvoltage for a reaction of the anode is low and no increase in potential of the anode is caused by effects of a side reaction even when electroplating is continued; 5) therefore, the electrolytic voltage is low and the low electrolytic voltage is maintained, by which the electric energy consumption rate for electroplating a target metal is decreased; 6) at the same time, no reduction in service life and durability of the anode is caused by the effects of a side reaction; and 7) a material which is high in durability for a main reaction is used. With regard to the above-described requirements, the inventor of the present application has already disclosed in Patent Literature 2 the anode in which a catalytic layer containing amorphous iridium oxide is formed on a conductive substrate as an anode suitable for electroplating which uses a sulfuric acid based electrolytic solution in production of electrolytic copper foil, etc. Further, in Patent Literature 3, there has also been disclosed the titanium electrode in which a catalytic layer containing amorphous iridium oxide is formed.

CITATION LIST

Patent Literature

PTL 1: Japanese Patent No. 3654204

PTL 2: Japanese Patent No. 3914162

PTL 3: Japanese Published Unexamined Patent Application No. 2007-146215

PTL 4: Japanese Published Unexamined Patent Application No. 2011-26691

PTL 5: Japanese Published Unexamined Patent Application No. 2011-17084

PTL 6: U.S. Patent Application Publication No. 2009/0288958

SUMMARY OF INVENTION

Technical Problem

As described above, in Patent Literature 2, the inventor of the present application has disclosed the anode for oxygen evolution in which a catalytic layer containing amorphous iridium oxide is formed on a conductive substrate and which is used for copper electroplating. Thereby, the inventor has clarified that the anode may be decreased in potential and electrolytic voltage for oxygen evolution in production of copper foil by electroplating and deposition of lead dioxide which occurs as a side reaction of the anode may be restrained. However, various types of electroplating which use an aqueous solution as an electrolytic solution including electroplating for production of electrolytic copper foil are required for a further increase in catalytic activity for a reaction of the anode and accordingly required for a further decrease in potential of the anode and electrolytic voltage in association therewith. In addition to a decrease in an electric energy consumption rate in electroplating, there has been required not an anode which uses a catalytic layer containing an expensive metal such as iridium as a component, for example, the oxide-coated titanium electrode disclosed in Patent Literatures 1 to 4 but an anode having a catalytic layer which is less expensive formed therein or an anode manufactured at a lower cost. Further, as a method for electroplating which uses an aqueous solution as an electrolytic solution as well, a method has been required for electroplating which may further reduce electrolytic voltage and also may reduce the cost by lowering the cost of the anode.

The present invention has been made in view of the above situations, an object of which is to provide an anode for electroplating which is high in catalysis for a main reaction of the anode and low in potential of the anode, when compared with a lead electrode, a lead alloy electrode, a metal-coated electrode and a metal oxide-coated electrode in electroplating which uses an aqueous solution as an electrolytic solution, thereby making it possible to decrease an electrolytic voltage in electroplating and lower an electric energy consumption rate for a metal to be electroplated, and the anode which may be used as an anode for electroplating various types of metals and also able to decrease costs of a catalytic layer and the anode when compared with a metal oxide-coated electrode used in electroplating, in particular, an electrode in which a conductive substrate is coated with a catalytic layer containing iridium oxide. Another object of the present invention is to provide a method for electroplating which uses an aqueous solution as an electrolytic solution and a method for electroplating in which the anode is low in potential and electrolytic voltage, thereby making it possible to decrease an electric energy consumption rate in electroplating, decrease initial cost and maintenance cost necessary for the anode and also decrease the entire cost necessary for electroplating.

Solution to Problem

As a result of intensive studies for solving the aforementioned problems, the inventor of the present application has completed the present invention by finding that the aforementioned problems could be solved by an anode with a catalytic layer containing amorphous ruthenium oxide and amorphous tantalum oxide formed on a conductive substrate and a method for electroplating using the anode.

That is, to solve the above-described problems, the anode for electroplating of the present invention has the following arrangements.

The anode for electroplating according to the first aspect of the present invention is an anode for electroplating used in electroplating which uses an aqueous solution as an electrolytic solution, in which a catalytic layer containing amorphous ruthenium oxide and amorphous tantalum oxide is arranged so as to be formed on a conductive substrate.

This arrangement provides the following effects.

(1) The catalytic layer containing amorphous ruthenium oxide and amorphous tantalum oxide shows a selectively high catalytic activity for oxygen evolution and chlorine evolution in electroplating which uses an aqueous solution as an electrolytic solution and the potential of the anode is considerably decreased.

(2) The anode is lower in potential for oxygen evolution than an electrode in which a catalytic layer containing crystalline iridium oxide is formed on a conductive substrate and an electrode in which a catalytic layer containing amorphous iridium oxide is formed on a conductive substrate, at the same time, the anode is capable of restraining a side reaction, providing a high catalytic activity and, therefore, decreasing an electrolytic voltage when compared with a case where another anode is used in electroplating which uses an aqueous solution as an electrolytic solution, irrespective of the type of a metal to be electroplated at a cathode.

(3) When compared with electroplating by using an anode with a catalytic layer containing amorphous iridium oxide formed therein and, in particular, an anode with a catalytic layer containing amorphous iridium oxide and amorphous tantalum oxide formed therein, the anode of the present invention is provided with a significantly unique effect that the potential of the anode may be further decreased and the electrolytic voltage may also be decreased.

(4) The anode is decreased in potential for oxygen evolution, and oxygen evolution is given a higher priority over other side reactions, thereby restraining side reactions such as deposition and accumulation of lead dioxide, etc., on the anode.

(5) Since ruthenium is one third or less the price of iridium, a catalytic activity higher than the catalytic activity of the catalytic layer containing amorphous iridium oxide and amorphous tantalum oxide may be achieved by a less expensive catalytic layer that contains amorphous ruthenium oxide and amorphous tantalum oxide.

Here, the conductive substrate may be preferably made of a valve metal such as titanium, tantalum, zirconium, niobium, tungsten, or molybdenum; an alloy predominantly composed of a valve metal such as titanium-tantalum, titanium-niobium, titanium-palladium, or titanium-tantalum-niobium; an alloy of a valve metal and a platinum group metal and/or a transition metal; or electrically conductive diamond (e.g., boron doped diamond), but the present invention is not limited thereto. Furthermore, the conductive substrate may be formed in various shapes such as plate-shaped, mesh-shaped, rod-shaped, sheet-shaped, tubular, wire-shaped, porous plate shaped, porous, or a three-dimensional porous structure in which spherical metal particles are bonded. As the conductive substrate other than the aforementioned ones, it is also acceptable to employ metals other than valve metals, such as iron or nickel, or electrically conductive ceramics which are coated with the aforementioned valve metals, alloys, or electrically conductive diamond, etc.

The invention according to the second aspect is the anode for electroplating according to the first aspect, in which the catalytic layer is arranged so as to be composed of a mixture of amorphous ruthenium oxide and amorphous tantalum oxide.

This arrangement provides the following effect in addition to those obtained in the first aspect.

(1) Since the catalytic layer is composed of a mixture of amorphous ruthenium oxide and amorphous tantalum oxide, such durability may be obtained that is applicable to electroplating which uses an aqueous solution as an electrolytic solution.

Here, Patent Literature 5 has disclosed a case that a coating layer composed of metal components of ruthenium and tantalum resulting from thermal decomposition at 480° C. is significantly low in durability in a sulfuric acid solution, as one of Comparative Examples. The above-described result is a problem found in a case that there is contained crystalline ruthenium oxide obtained when thermal decomposition is performed at a temperature of at least 350° C. or higher. With regard to this, the inventor of the present application has found that an anode with a catalytic layer formed in which amorphous ruthenium oxide is made in a mixture with amorphous tantalum oxide does not pose such a problem of durability that has been described in Patent Literature 5 as an anode for electroplating which uses an aqueous solution as an electrolytic solution.

Here, the present invention will be described in more detail below. The catalytic layer containing amorphous ruthenium oxide and amorphous tantalum oxide may be formed on the conductive substrate by thermal decomposition, in which a precursor solution containing ruthenium and tantalum is applied to the conductive substrate and then heated at a predetermined temperature. Other than the thermal decomposition, it is also possible to employ various types of physical vapor deposition or chemical vapor deposition methods, etc., such as sputtering and CVD. In particular, among those methods for making the anode for electroplating of the present invention, the method for making the anode by thermal decomposition will be described. For example, a precursor solution containing ruthenium and tantalum in a variety of forms such as an inorganic compound, an organic compound, an ion, or a complex is applied to a titanium substrate, which is then thermally decomposed at temperatures in a range lower than at least 350° C., thereby forming a catalytic layer containing amorphous ruthenium oxide and amorphous tantalum oxide on the titanium substrate. For example, a butanol solution in which ruthenium chloride hydrate and tantalum chloride are dissolved is employed as a precursor solution, which is then applied to the titanium substrate and thermally decomposed. At this time, for example, when the mole ratio of ruthenium to tantalum in the butanol solution is from 10:90 to 90:10, the catalytic layer containing amorphous ruthenium oxide and amorphous tantalum oxide is formed at a thermal decomposition temperature of 300° C. Furthermore, by thermal decomposition at 280° C. after the application of the aforementioned precursor solution, the catalytic layer of a mixture of amorphous ruthenium oxide and amorphous tantalum oxide may be formed. It is noted that the mole ratio of ruthenium to tantalum in the catalytic layer of the anode for electroplating of the present invention shall not be limited to the above-described range.

When the catalytic layer containing amorphous ruthenium oxide and amorphous tantalum oxide is formed on a conductive substrate by thermal decomposition, it varies whether amorphous ruthenium oxide and amorphous tantalum oxide are contained in the catalytic layer, depending on the mole ratio of ruthenium to tantalum contained in the precursor solution to be applied to the titanium substrate and the thermal decomposition temperature. Furthermore, when a metal component other than ruthenium and tantalum is contained in the precursor solution, it also varies depending on the type of the metal component and the mole ratio of the metal component to all metal components contained in the precursor solution, etc. For example, when the same components other than metal components are contained in the precursor solution and only ruthenium and tantalum are contained as metal components, a lower mole ratio of ruthenium in the precursor solution would tend to show a greater range of thermal decomposition temperatures in which the catalytic layer containing amorphous ruthenium oxide and amorphous tantalum oxide is obtained. Furthermore, the conditions for forming the catalytic layer containing amorphous ruthenium oxide and amorphous tantalum oxide also vary depending not only on the mole ratio of such metal components but also on the method for preparing and the material of the precursor solution, for example, raw materials of ruthenium and tantalum used to prepare the precursor solution, the type of a solvent, and the type and concentration of an additive that may be added to accelerate thermal decomposition.

Therefore, for the anode for electroplating of the present invention, the conditions for forming, by thermal decomposition, the catalytic layer containing amorphous ruthenium oxide and amorphous tantalum oxide are not limited to the use of the butanol solvent, the mole ratio of ruthenium to tantalum, and the range of thermal decomposition temperatures associated therewith in the thermal decomposition method mentioned above. The aforementioned conditions are only an example, and the method for making the anode for electroplating of the present invention may include any methods other than those mentioned above as long as the methods are available to forming the catalytic layer containing amorphous ruthenium oxide and amorphous tantalum oxide on the conductive substrate. For example, as a matter of course, such methods may include one which is disclosed in Patent Literature 6 that involves a heating step in the preparation process of the precursor solution. Note that the formation of the catalytic layer containing amorphous ruthenium oxide and amorphous tantalum oxide may be known from the fact that by a typically employed X-ray diffraction method, a diffraction peak equivalent to ruthenium oxide or tantalum oxide is not observed or made broad.

The invention according to the third aspect is the anode for electroplating according to the first aspect or the second aspect, in which a mole ratio of ruthenium to tantalum in the catalytic layer is arranged to be 50:50.

This arrangement provides the following effect in addition to those obtained in the first aspect or the second aspects.

(1) The above-described composition provides such catalysis that is excellent both in oxygen evolution and chlorine evolution in particular.

The invention according to the fourth aspect is the anode for electroplating according to any one of the first aspect to the third aspect, in which an intermediate layer is arranged so as to be formed between the catalytic layer and the conductive substrate.

This arrangement provides the following effects in addition to those obtained in any one of the first aspect to the third aspect.

(1) The intermediate layer is formed between the catalytic layer and the conductive substrate and at the same time, the surface of the conductive substrate is coated, thereby preventing the electrolytic solution from reaching the conductive substrate even when the electrolytic solution penetrates into the catalytic layer. Thus, the conductive substrate will never be corroded by the electrolytic solution, thereby preventing an unsmooth current flow between the conductive substrate and the catalytic layer caused by corrosion.

(2) When an intermediate layer is formed which is made of oxide or composite oxide and which is different from the catalytic layer of the anode for electroplating of the present invention, the catalytic activity of the intermediate layer for the main reaction of the anode is low when compared with the catalytic layer containing amorphous ruthenium oxide and amorphous tantalum oxide. Thus, even when the electrolytic solution penetrates into the catalytic layer and reaches the intermediate layer, the intermediate layer has a higher durability than the catalytic layer and thus protects the conductive substrate because oxygen and/or chlorine evolution do not occur on the intermediate layer at a higher priority than on the catalytic layer. At the same time, the conductive substrate is coated with such an oxide or composite oxide having a higher durability, thereby further preventing the corrosion of the conductive substrate by the electrolytic solution when compared with the case of no intermediate layer provided.

Here, the intermediate layer has a lower catalytic activity for the main reaction of the anode than the catalytic layer but sufficiently coats the conductive substrate, thus restraining corrosion of the conductive substrate. The intermediate layer may be made of, for example, metal, alloy, a carbon based material such as boron doped diamond (electrically conductive diamond), a metal compound such as an oxide and a sulfide, and a composite compound such as a metal composite oxide. For example, the intermediate layer would be formed with a metal, in the case of which a thin film of tantalum or niobium, etc., may be preferably employed. The intermediate layer would also be formed with an alloy, in the case of which preferably employed are, for example, an alloy of tantalum, niobium, tungsten, molybdenum, titanium or platinum, etc. The intermediate layer made by using a carbon based material such as boron doped diamond (electrically conductive diamond) also has the same effects. The intermediate layer made of the above-described metal, alloy or carbon based material may be formed by thermal decomposition, various types of physical vapor deposition or chemical vapor deposition methods such as sputtering and CVD or by a variety of methods such as hot dipping and electroplating. For example, the intermediate layer made of a metal compound such as an oxide and a sulfide or a metal composite oxide may preferably include an intermediate layer made of an oxide containing crystalline iridium oxide, etc. In particular, where the catalytic layer is prepared by thermal decomposition, it is advantageous, from the viewpoint of simplifying making processes of the anode, to form the intermediate layer of an oxide or a composite oxide in the same manner by thermal decomposition.

The invention according to the fifth aspect is the anode for electroplating according to the fourth aspect and is adopted such that the intermediate layer is made of tantalum, niobium, tungsten, molybdenum, titanium, platinum or any one of alloys of these metals.

This arrangement provides the following effects in addition to those obtained in the fourth aspect.

(1) The above-described metals or alloys are used as the intermediate layer, by which it is possible to effectively restrain corrosion of the conductive substrate.

(2) It is effective in production of the intermediate layer because the intermediate layer may be formed by thermal decomposition, various types of physical vapor deposition or chemical vapor deposition methods such as sputtering and CVD or by a variety of methods such as hot dipping and electroplating.

The invention according to the sixth aspect is the anode for electroplating according to the fourth aspect, in which the intermediate layer is arranged so as to contain crystalline iridium oxide and amorphous tantalum oxide.

This arrangement provides the following effect in addition to those obtained in the fourth aspect.

(1) Since the intermediate layer is high in durability for oxygen evolution, and ruthenium oxide in the catalytic layer and iridium oxide in the intermediate layer belong to the same crystal group and have a close interatomic distance, the intermediate layer and the catalytic layer formed thereon have a good adhesion therebetween. Thus, durability is distinctively improved where oxygen evolution is a main reaction of the anode.

Here, the intermediate layer containing crystalline iridium oxide and amorphous tantalum oxide may be made by thermal decomposition in which a precursor solution containing iridium and tantalum is applied to the conductive substrate and then heated at a predetermined temperature. The intermediate layer may also be made by various types of physical vapor deposition or chemical vapor deposition methods, etc., such as sputtering and CVD. For example, in the case of the thermal decomposition, preferable is such an intermediate layer that is composed of crystalline iridium oxide and amorphous tantalum oxide obtained by thermally decomposing a precursor solution containing iridium and tantalum at a temperature from 400° C. to 550° C.

The invention according to the seventh aspect is the anode for electroplating according to the fourth aspect, in which the intermediate layer is arranged so as to contain a crystalline composite oxide of ruthenium and titanium.

This arrangement provides the following effect in addition to those obtained in the fourth aspect.

(1) Since the intermediate layer containing a crystalline composite oxide of ruthenium and titanium is high in durability for chlorine evolution, and ruthenium oxide in the catalytic layer and a composite oxide in the intermediate layer belong to the same crystal group and have a close interatomic distance, the intermediate layer and the catalytic layer formed thereon have a good adhesion therebetween. Thus, durability is distinctively improved where chlorine evolution is a main reaction of the anode.

Here, the intermediate layer containing a crystalline composite oxide of ruthenium and titanium may be made by thermal decomposition in which a precursor solution containing ruthenium and titanium is applied to the conductive substrate and thereafter heated at a predetermined temperature. The intermediate layer may also be made by various types of physical vapor deposition or chemical vapor deposition methods, etc., such as sputtering and CVD. For example, in the case of the thermal decomposition, preferable is such an intermediate layer which is made of a crystalline composite oxide of ruthenium and titanium that is obtained by thermally decomposing a precursor solution containing ruthenium and titanium at a temperature from 450° C. to 550° C.

The invention according to the eighth aspect is the anode for electroplating according to the fourth aspect, in which the intermediate layer is arranged so as to contain crystalline ruthenium oxide and amorphous tantalum oxide.

This arrangement provides the following effect in addition to those obtained in the fourth aspect.

(1) Since the intermediate layer containing crystalline ruthenium oxide and amorphous tantalum oxide is high in durability for chlorine evolution, ruthenium oxide in the catalytic layer and ruthenium oxide in the intermediate layer belong to the same crystal group and have a close interatomic distance, the intermediate layer and the catalytic layer formed thereon have a good adhesion therebetween. Thus, durability is distinctively improved where chlorine evolution is a main reaction of the anode.

Here, the intermediate layer containing crystalline ruthenium oxide and amorphous tantalum oxide may be made by thermal decomposition in which a precursor solution containing ruthenium and tantalum is applied to the conductive substrate and thereafter heated at a predetermined temperature. The intermediate layer may also be made by various types of physical vapor deposition or chemical vapor deposition methods, etc., such as sputtering and CVD. For example, in the case of the thermal decomposition, preferable is such an intermediate layer which is made of crystalline ruthenium oxide and amorphous tantalum oxide that are obtained by thermally decomposing a precursor solution containing ruthenium and tantalum at a temperature from 400° C. to 550° C.

The invention according to the ninth aspect is the anode for electroplating according to the fourth aspect, in which the intermediate layer is arranged so as to be electrically conductive diamond.

This arrangement provides the following effect in addition to those obtained in the fourth aspect.

(1) The intermediate layer is electrically conductive diamond and therefore quite high in corrosion resistance against an acidic aqueous solution. It is therefore possible to effectively restrain corrosion of the conductive substrate in particular.

The invention according to the tenth aspect is the anode for electroplating according to any one of the first aspect to the ninth aspect, in which metal to be electroplated is arranged so as to be any one of copper, zinc, tin, nickel, cobalt, lead, chromium, indium, platinum, silver, iridium, ruthenium and palladium.

This arrangement provides the following effect in addition to those obtained in any one of the first aspect to the ninth aspect.

(1) The anode is low in potential for oxygen evolution. It is, therefore, possible to decrease an electrolytic voltage in electroplating and also lower an electric energy consumption rate for a metal to be electroplated. The anode may be used as an anode for electroplating in various types of metals, finding a variety of applications.

The method for electroplating according to the eleventh aspect of the present invention is a method for electroplating which uses an aqueous solution as an electrolytic solution and in which the anode for electroplating according to any one of the first aspect to the ninth aspect is used to electroplate a desired metal.

This arrangement provides the following effect.

(1) In the method for electroplating which uses an aqueous solution as an electrolytic solution, the anode for electroplating is low in potential and electrolytic voltage, thereby making it possible to lower an electric energy consumption rate in electroplating and also able to decrease initial cost and maintenance cost necessary for the anode for electroplating and also decrease the entire cost necessary for electroplating.

The invention according to the twelfth aspect is the method for electroplating according to the eleventh aspect, in which a metal to be electroplated is arranged so as to be any one of copper, zinc, tin, nickel, cobalt, lead, chromium, indium, platinum, silver, iridium, ruthenium and palladium.

This arrangement provides the following effect in addition to that obtained in the eleventh aspect.

(1) In this method, an electrolytic voltage is low and the low electrolytic voltage is maintained even in long-term electroplating, by which the electric energy consumption rate for electroplating a target metal is decreased. It is possible to prevent a reduction in service life and durability of the anode for electroplating caused by the effects of a side reaction and also to electroplate a target metal over a longer period of time and with stability. Therefore, there is provided electroplating excellent in efficiency and stability.

Advantageous Effects of Invention

The present invention provides the effects listed below.

1) In the electroplating which uses an aqueous solution as an electrolytic solution, the anode potential may be decreased when compared with a conventional anode. Therefore, irrespective of a type of a metal to be electroplated, an electrolytic voltage of the electroplating may be decreased to lower an electric energy consumption rate to a great extent.

2) Further, since the anode potential may be decreased when compared with a conventional anode, it is possible to restrain various side reactions which may take place on the anode. Thus, the electrolytic voltage may be prevented from being increased in long-term electroplating.

3) In addition to the above-described effects, the present invention provides the effect to eliminate or reduce the work for removing an oxide or other chemical compounds which would be otherwise deposited and accumulated by a side reaction on the anode. Thus, the damage to the anode that would be caused by such work is restrained, thereby providing a prolonged service life of the anode.

4) In addition to the above-described effects, the present invention provides the effect to eliminate or decrease the work for removing an oxide or other chemical compounds which would be otherwise deposited and accumulated on the anode by a side reaction. Thus, maintenance and replacement of the anode in electroplating may be decreased or reduced. Further, the need for such removing work is eliminated or decreased so that a necessity for suspending electroplating is restrained, thus making it possible to realize continuous and more stable electroplating.

5) In addition to the above-described effects, the present invention provides the effect in which deposits on the anode are restrained, thus making it possible to prevent an effective surface area of the anode from being restricted by the deposits and also prevent an area of the anode available for electrolysis from being non-uniformly formed. Thus, it is possible to prevent a metal from being non-uniformly electroplated on a cathode and also restrain deterioration of the quality such as production of an unsmooth metal film or metal foil by electroplating and decrease in density thereof.

6) Further, it is possible to prevent metal which has grown non-uniformly on the cathode from reaching and short-circuiting the anode due to the above-described reasons, thereby preventing a failure of electroplating. Still further, metal is prevented from growing non-uniformly and in a dendrite form on the cathode. It is therefore possible to decrease the inter-electrode distance between the anode and the cathode, and restrain an increase in electrolytic voltage resulting from ohmic loss of an electrolytic solution.

7) Further, since various problems that would be otherwise caused by the deposits on the anode resulting from a side reaction are resolved as described above, it is possible to continuously perform stable electroplating and decrease maintenance and management work in electroplating. And, it is also possible to easily perform product management of a metal to be electroplated. Still further, it is possible to decrease the cost of the anode in long-term electroplating.

8) Furthermore, according to the present invention, when compared with a conventional titanium electrode with a catalytic layer containing iridium oxide formed thereon, use of ruthenium oxide reduces the cost of the catalytic layer; and a reduced thermal decomposition temperature reduces the cost of the process of forming the catalytic layer as well.

9) In addition to the above-described effects, the present invention provides the effect of significantly decreasing the entire cost of electroplating in electroplating of various types of metals.

DESCRIPTION OF EMBODIMENTS

Hereinafter, the present invention will be described in more detail in accordance with the Examples and Comparative Examples. However, the present invention is not limited to the following Examples. The present invention is also applicable to electroplating of metals other than zinc, copper, nickel and platinum.

EXAMPLES

Electrogalvanizing

Example 1

A commercially available titanium plate (5 cm in length, 1 cm in width, 1 mm in thickness) was immersed and etched in a 10% oxalic acid solution at 90° C. for 60 minutes and then washed and dried. Next, prepared was a coating solution which was obtained by adding ruthenium trichloride trihydrate ($RuCl_3.3H_2O$) and tantalum pentachloride ($TaCl_5$) to a butanol (n-$C_4H_9OH$) solution containing 6 vol % concentrated hydrochloric acid so that the mole ratio of ruthenium to tantalum is 50:50 and the total of ruthenium and tantalum is 50 g/L in terms of metal. This coating solution was applied to the titanium plate dried as mentioned above, dried at 120° C. for 10 minutes, and then thermally decomposed for 20 minutes in an electric furnace that was held at 280° C. This series of application, drying, and thermal decomposition was repeated seven times in total in order to prepare an anode for electroplating of Example 1, the anode having a catalytic layer formed on the titanium plate that was a conductive substrate.

An X-ray diffraction analysis of the structure of the anode for electroplating of Example 1 showed that a diffraction peak equivalent to $RuO_2$ was not observed in an X-ray diffraction image and a diffraction peak equivalent to $Ta_2O_5$ was not observed. Further, XPS (X-ray photoelectron spectroscopy) was performed to make an analysis of chemical states of ruthenium, tantalum and oxygen, thereby it was found that the catalytic layer was a mixture of $RuO_2$ and $Ta_2O_5$. That is, the anode for electroplating of Example 1 had a catalytic layer composed of amorphous ruthenium oxide and amorphous tantalum oxide formed on the titanium plate.

A commercially available electrogalvanizing solution (made by Marui Galvanizing Co., Ltd., zinc concentration of about 80 g/L, pH=−1) was used as an electrolytic solution and a zinc plate (2 cm×2 cm) was immersed in the electrolytic solution as a cathode. Furthermore, the above-described anode for electroplating was mounted in a polytetrafluoroethylene holder, and then, with the electrode area in contact with the electrolytic solution restricted to 1 $cm^2$, was disposed in the same electrolytic solution so as to be opposed to the aforementioned cathode with a predetermined inter-electrode distance. Further, a saturated potassium chloride aqueous solution was placed into a vessel different from that of the electrolytic solution and a commercially available silver-silver chloride electrode was immersed in the saturated potassium chloride aqueous solution as a reference electrode. The saturated potassium chloride aqueous solution was connected to the electrolytic solution by using a salt bridge and a Luggin capillary to prepare a three-electrode type electrochemical measurement cell. An electrolytic current with the current density of either 10 $mA/cm^2$ or 20 $mA/cm^2$ based on an electrode area of the anode for electroplating was allowed to flow between the anode for electroplating and the cathode, while electrogalvanizing was performed on the cathode, thereby measuring a potential of the anode for electroplating with respect to the reference electrode. It is noted that the electrolytic solution was kept at a temperature of 40° C. by using a thermobath.

Comparative Example 1

A commercially available titanium plate (5 cm in length, 1 cm in width, 1 mm in thickness) was immersed and etched in a 10% oxalic acid solution at 90° C. for 60 minutes and then washed and dried. Next, prepared was a coating solution which was obtained by adding hexachloroiridic acid hexahydrate ($H_2IrCl_6.6H_2O$) and tantalum chloride ($TaCl_5$) to a butanol (n-$C_4H_9OH$) solution containing 6 vol % concentrated hydrochloric acid so that a mole ratio of iridium to tantalum was 50:50 and a total of iridium and tantalum was 70 g/L in terms of metal. This coating solution was applied to the titanium plate dried as mentioned above, dried at 120° C. for 10 minutes, and then thermally decomposed for 20 minutes in an electric furnace that was held at 360° C. This series of application, drying and thermal decomposition was repeated five times in total in order to prepare an anode for electroplating of Comparative Example 1 in which a catalytic layer was formed on the titanium plate that was a conductive substrate.

An X-ray diffraction analysis of the structure of the anode for electroplating of Comparative Example 1 showed that a diffraction peak equivalent to $IrO_2$ was not observed in an X-ray diffraction image and a diffraction peak equivalent to $Ta_2O_5$ was not observed. Further, XPS (X-ray photoelectron spectroscopy) was performed to make an analysis of chemical states of iridium, tantalum and oxygen, thereby it was found that the catalytic layer was a mixture of $IrO_2$ and $Ta_2O_5$. That is, the anode for electroplating of Comparative Example 1 had a catalytic layer composed of amorphous iridium oxide and amorphous tantalum oxide formed on the titanium plate.

Under the same conditions as those of Example 1 except that the anode for electroplating of Comparative Example 1 was used in place of the anode for electroplating of Example 1, an electrolytic current with the current density of either 10 mA/cm$^2$ or 20 mA/cm$^2$ based on an electrode area of the anode for electroplating was allowed to flow between the anode for electroplating and the cathode, measurement was made for a potential of the anode for electroplating with respect to the reference electrode, while electrogalvanizing on the cathode was performed.

The anode for electroplating of Example 1 or Comparative Example 1 was used to measure a potential of the anode on performing electrogalvanizing, the results of which are shown in Table 1.

TABLE 1

| | Anode potential | | Difference in anode potential (Degree of improvement) |
|---|---|---|---|
| Current density | Example 1 | Comparative Example 1 | Comparative Example 1-Example 1 |
| 10 mA/cm$^2$ | 1.39 V | 1.43 V | 0.04 V |
| 20 mA/cm$^2$ | 1.47 V | 1.52 V | 0.05 V |

As shown in Table 1, where electrogalvanizing was performed by using the anode for electroplating of Example 1 having a catalytic layer composed of amorphous ruthenium oxide and amorphous tantalum oxide formed therein, the electrolytic voltage was decreased by 0.04 V to 0.05 V, when compared with the case in which the anode for electroplating of Comparative Example 1 having a catalytic layer composed of amorphous iridium oxide and amorphous tantalum oxide formed therein was used. That is, the anode for electroplating (Example 1) having a catalytic layer composed of amorphous ruthenium oxide and amorphous tantalum oxide formed therein was further decreased in potential than the anode for electroplating (Comparative Example 1) having a catalytic layer composed of amorphous iridium oxide and amorphous tantalum oxide formed therein. Thereby, it was found that a decrease in electrolytic voltage for electrogalvanizing was realized.

Copper Electroplating

Example 2

Under the same conditions as those of Example 1 except that the electrolytic solution of Example 1 was changed to a commercially available copper electroplating solution (made by Marui Galvanizing Co., Ltd., copper concentration of about 91 g/L, pH=6.6), measurement was made for a potential of the anode for electroplating with respect to the reference electrode, while copper electroplating was performed.

Comparative Example 2

Under the same conditions as those of Comparative Example 1 except that the electrolytic solution of Comparative Example 1 was changed to a commercially available copper electroplating solution (made by Marui Galvanizing Co., Ltd., copper concentration of about 91 g/L, pH=6.6), measurement was made for a potential of the anode for electroplating with respect to the reference electrode, while copper electroplating was performed.

The anode for electroplating of Example 2 or Comparative Example 2 was used to measure a potential of the anode on performing copper electroplating, the results of which are shown in Table 2.

TABLE 2

| | Anode potential | | Difference in anode potential (Degree of improvement) |
|---|---|---|---|
| Current density | Example 2 | Comparative Example 2 | Comparative Example 2-Example 2 |
| 10 mA/cm$^2$ | 1.21 V | 1.31 V | 0.10 V |
| 20 mA/cm$^2$ | 1.30 V | 1.39 V | 0.09 V |

As shown in Table 2, where copper electroplating was performed by using the anode for electroplating of Example 2 having a catalytic layer composed of amorphous ruthenium oxide and amorphous tantalum oxide formed therein, the electrolytic voltage thereof was decreased by 0.09 V to 0.10 V, when compared with the case in which the anode for electroplating of Comparative Example 2 having a catalytic layer composed of amorphous iridium oxide and amorphous tantalum oxide formed therein was used. That is, the anode for electroplating (Example 2) having a catalytic layer composed of amorphous ruthenium oxide and amorphous tantalum oxide formed therein was further decreased in potential than the anode for electroplating (Comparative Example 2) having a catalytic layer composed of amorphous iridium oxide and amorphous tantalum oxide formed therein. Thereby, it was found that a decrease in electrolytic voltage for copper electroplating was realized.

Nickel Electroplating

Example 3

Under the same conditions as those of Example 1 except that the electrolytic solution of Example 1 was changed to a commercially available nickel electroplating solution (made by Marui Galvanizing Co., Ltd., nickel salt concentration of 18%, pH=7.7), measurement was made for a potential of the anode for electroplating with respect to the reference electrode, while nickel electroplating was performed.

Comparative Example 3

Under the same conditions as those of Comparative Example 1 except that the electrolytic solution of Comparative Example 1 was changed to a commercially available nickel electroplating solution (made by Marui Galvanizing Co., Ltd., nickel salt concentration of 18%, pH=7.7), measurement was made for a potential of the anode for electroplating with respect to the reference electrode, while nickel electroplating was performed.

The anode for electroplating of Example 3 or Comparative Example 3 was used to measure a potential of the anode on performing nickel electroplating, the results of which are shown in Table 3.

TABLE 3

| | Anode potential | | Difference in anode potential (Degree of improvement) |
|---|---|---|---|
| Current density | Example 3 | Comparative Example 3 | Comparative Example 3-Example 3 |
| 10 mA/cm$^2$ | 0.98 V | 1.13 V | 0.15 V |
| 20 mA/cm$^2$ | 1.07 V | 1.22 V | 0.15 V |

As shown in Table 3, where nickel electroplating was performed by using the anode for electroplating of Example 3 having a catalytic layer composed of amorphous ruthenium oxide and amorphous tantalum oxide formed therein, the electrolytic voltage was decreased by 0.15 V, when compared with the case in which the anode for electroplating of Comparative Example 3 having a catalytic layer composed of amorphous iridium oxide and amorphous tantalum oxide formed therein was used. That is, the anode for electroplating (Example 3) having a catalytic layer composed of amorphous ruthenium oxide and amorphous tantalum oxide formed therein was further decreased in potential than the anode for electroplating (Comparative Example 3) having a catalytic layer composed of amorphous iridium oxide and amorphous tantalum oxide formed therein. Thereby, it was found that a decrease in electrolytic voltage for nickel electroplating was realized.

Platinum Electroplating

Example 4

Under the same conditions as those of Example 1 except that the electrolytic solution of Example 1 was changed to a commercially available platinum electroplating solution (made by Marui Galvanizing Co., Ltd., platinum compound concentration of about 2%, potassium hydroxide concentration of about 1.5%, pH=12.2), measurement was made for a potential of the anode for electroplating with respect to the reference electrode, while platinum electroplating was performed.

Comparative Example 4

Under the same conditions as those of Comparative Example 1 except that the electrolytic solution of Comparative Example 1 was changed to a commercially available platinum electroplating solution (made by Marui Galvanizing Co., Ltd., platinum compound concentration of about 2%, potassium hydroxide concentration of about 1.5%, pH=12.2), measurement was made for a potential of the anode for electroplating with respect to the reference electrode, while platinum electroplating was performed.

Where platinum electroplating was performed by using the anode for electroplating of Example 4, a potential of the anode was 0.95 V at the current density of 10 mA/cm$^2$ and 1.24 V at the current density of 20 mA/cm$^2$. It is noted that measurement was made for a potential of the anode for electroplating of Comparative Example 4 as well, however, the potential was not stabilized from immediately after the start of electrolysis, and, the potential acutely increased, thereby it was not possible to measure a stable potential of the anode. When the anode for electroplating was taken out from the electrolytic solution after measurement of the potential of the anode of Comparative Example 4, it was found that the catalytic layer on the titanium plate was changed in shape and the catalytic layer was deteriorated.

Tin Electroplating

Example 5

Under the same conditions as those of Example 1 except that the electrolytic solution of Example 1 was changed to a commercially available tin electroplating solution (made by Marui Galvanizing Co., Ltd., pH=0.13) and the temperature was changed to 25° C., measurement was made for a potential of the anode for electroplating with respect to the reference electrode, while tin electroplating was performed.

Comparative Example 5

Under the same conditions as those of Comparative Example 1 except that the electrolytic solution of Comparative Example 1 was changed to a commercially available tin electroplating solution (made by Marui Galvanizing Co., Ltd., pH=0.13) and the temperature was changed to 25° C., measurement was made for a potential of the anode for electroplating with respect to the reference electrode, while tin electroplating was performed.

The anode for electroplating of Example 5 or Comparative Example 5 was used to measure a potential of the anode on performing tin electroplating, the results of which are shown in Table 4.

TABLE 4

| | Anode potential | | Difference in anode potential (Degree of improvement) |
|---|---|---|---|
| Current density | Example 5 | Comparative Example 5 | Comparative Example 5-Example 5 |
| 10 mA/cm$^2$ | 1.44 V | 1.66 V | 0.22 V |

As shown in Table 4, where tin electroplating was performed by using the anode for electroplating of Example 5 having a catalytic layer composed of amorphous ruthenium oxide and amorphous tantalum oxide formed therein, the electrolytic voltage was decreased by 0.22 V, when compared with the case in which the anode for electroplating of Comparative Example 5 having a catalytic layer composed of amorphous iridium oxide and amorphous tantalum oxide formed therein was used. That is, the anode for electroplating (Example 5) having a catalytic layer composed of amorphous ruthenium oxide and amorphous tantalum oxide formed therein was further decreased in potential than the anode for electroplating (Comparative Example 5) having a catalytic layer composed of amorphous iridium oxide and amorphous tantalum oxide formed therein. Thereby, it was found that a decrease in electrolytic voltage for tin electroplating was realized.

INDUSTRIAL APPLICABILITY

The present invention is able to provide an anode for electroplating which is high in catalysis for a main reaction of the anode and low in potential, when compared with a lead electrode, a lead alloy electrode, a metal-coated electrode and a metal oxide-coated electrode in electroplating which uses an aqueous solution as an electrolytic solution, thereby making it possible to decrease an electrolytic voltage in electroplating and also to lower an electric energy consumption rate for a metal to be electroplated, and the anode which may be used as an anode for electroplating various types of metals and also able to decrease costs of a catalytic layer and those of the anode, when compared with a metal oxide-coated electrode used in electroplating, in particular, an electrode in which a conductive substrate is coated with a catalytic layer containing iridium oxide. The present invention is also able to provide a method for electroplating which uses an aqueous solution as an electrolytic solution, and the method for electroplating in which the anode is low in potential and electrolytic voltage, thereby making it possible to decrease an electric energy consumption rate in electroplating and also decrease initial cost and maintenance cost necessary for the anode and also decrease the entire cost necessary for electroplating.

The invention claimed is:

1. A method for electroplating which comprises electroplating a desired metal present in an aqueous electrolytic solution onto a cathode with an anode comprising a conductive substrate and a catalytic layer formed on the conductive substrate, and the catalytic layer is composed of amorphous ruthenium oxide and amorphous tantalum oxide and does not contain $IrO_2$.

2. The method for electroplating according to claim 1, wherein the desired metal is any one of copper, zinc, tin, nickel, cobalt, lead, chromium, indium, platinum, silver, iridium, ruthenium and palladium.

3. The method for electroplating according to claim 1, wherein a mole ratio of ruthenium to tantalum in the catalytic layer is 50:50.

4. The method for electroplating according to claim 3, wherein the desired metal is any one of copper, zinc, tin, nickel, cobalt, lead, chromium, indium, platinum, silver, iridium, ruthenium and palladium.

5. The method for electroplating according to claim 1, wherein the anode further comprises an intermediate layer formed between the catalytic layer and the conductive substrate.

6. The method for electroplating according to claim 5, wherein the intermediate layer contains crystalline iridium oxide and amorphous tantalum oxide.

7. The method for electroplating according to claim 6, wherein the desired metal is any one of copper, zinc, tin, nickel, cobalt, lead, chromium, indium, platinum, silver, iridium, ruthenium and palladium.

8. The method for electroplating according to claim 5, wherein the desired metal is any one of copper, zinc, tin, nickel, cobalt, lead, chromium, indium, platinum, silver, iridium, ruthenium and palladium.

9. The method for electroplating according to claim 1, wherein the catalytic layer consists of amorphous ruthenium oxide and amorphous tantalum oxide.

* * * * *